United States Patent [19]

Wilson et al.

[11] 4,255,080

[45] Mar. 10, 1981

[54] FANS OR THE LIKE

[75] Inventors: Robert R. Wilson, Kilmacolm; Roy D. Falconer, Bridge of Weir, both of Scotland

[73] Assignee: James Howden & Company Limited, Glasgow, Scotland

[21] Appl. No.: 23,349

[22] Filed: Mar. 23, 1979

[30] Foreign Application Priority Data

Mar. 28, 1978 [GB] United Kingdom ..... 11928/78

[51] Int. Cl.[3] ..... F04D 1/00

[52] U.S. Cl. ..... 415/53 R

[58] Field of Search ..... 415/52, 53 R, 55, 59, 415/106

[56] References Cited

U.S. PATENT DOCUMENTS

| | | | |
|---|---|---|---|
| 1,114,866 | 10/1914 | Davidson | 415/53 R |
| 2,327,841 | 8/1943 | Hagen | 415/53 R |
| 2,423,634 | 7/1947 | Berliner | 415/53 R |
| 4,116,171 | 9/1978 | Schulmeister et al. | 415/53 R |
| 4,171,928 | 10/1979 | Emerson | 415/106 |

*Primary Examiner*—Louis J. Casaregola

*Attorney, Agent, or Firm*—Mason, Fenwick & Lawrence

[57] ABSTRACT

In a centrifugal fan or the like including an impeller housed in a casing, recirculation means are provided to recycle a portion of the gas discharge back to the blades of the impeller. Specifically these means comprise a radial passage between an impeller shroud and a wall of the casing, and aperture means in the shroud. 15% to approximately 30% of the gas discharge may be recycled. This arrangement has the advantage of increasing the fan pressure at low discharge rates in comparison with previous fans with no gas recirculation, and this is advantageous in some fan installations where operation is at reduced rates for considerable periods.

9 Claims, 11 Drawing Figures

FANS OR THE LIKE

The present invention relates to fans, and blowers or the like (hereinafter referred to generally as fans for convenience) and to compressors.

A fan is a rotary fluid machine comprising a rotary blading housed in a casing having a gas inlet and a gas outlet, and serves for the delivery of gaseous fluid, the delivery usually being measured in $m^3$/sec. (which delivery is termed the fan capacity). In a centrifugal fan there is provided an impeller having peripheral vanes or blades mounted on a radial support plate, and gas is delivered to the eye of the impeller whence it is discharged radially by the rotating vanes. The performance of a fan is customarily represented by a series of graphs (the fan characteristic curves) of various criterea against the fan capacity: these criterea are for example shaft horsepower, efficiency and pressure or head (usually measured in K Pa). Generally in a centrigual fan, the pressure against capacity curve is a peaking curve with a fall off in pressure as the capacity is reduced towards zero, and it has been found that this characteristic is not satisfactory for some fan installations or systems.

It is an object of the present invention to obviate or mitigate this disadvantage. The present invention provides a centrifugal fan or compressor.

It has been found that this recirculation of gas to the vanes in a fan adjusts the pressure/capacity characteristic of the fan to a form more suited for some fan installations or systems. In particular, it has been found for a centrifugal fan that the pressure fall-off for low delivery rates is avoided; and indeed the pressure can in fact increase for low delivery rates.

The centrifugal fan (or compressor) may be a single inlet machine, and the impeller can include a radial back plate defining a shroud on which the vanes are mounted; and the radial fluid passage is defined between said back plate and the casing. It has been a general practice heretofoe in centrifugal fans to place said impeller back plate with a small clearance space relative to the casing, and it is a characteristic of the above arrangement according to the present invention that the back plate is so positioned as to substantially increase the space between the back plate and the casing.

In an alternative arrangement the gas recirculation is achieved at the front end of the impeller of the centrifugal fan. Thus notches may be provided on a front vane shroud with the radial fluid passage for the recirculated gas adjacent said front shroud. This front recirculation can be conveniently used in centrifugal fans of the double-inlet type.

Preferably the aperture means comprise an annular series of notches in the shroud, each being preferably located between successive vanes of the impeller. The notches may extend over only part of the radial depth of the vanes, or may extend over the full radial depth or indeed have a radial depth even greater than that of the vanes.

Preferably the notches are of general "V" configuration, with one of the sides of the "V" preferably coinciding with a side vane edge. With forwardly or backwardly inclined vanes the other side of the "V" can lie on an impeller radial line.

It will be readily understood that other forms of aperture profile could be used, for example round holes.

According to another aspect of the present invention a method of operation of a fan or the like include recycling up to approximatey 30% of the gas discharge to the fan blades.

Embodiments of the present invention will now be described by way of example with reference to the accompanying drawings in which.

Figure 1:
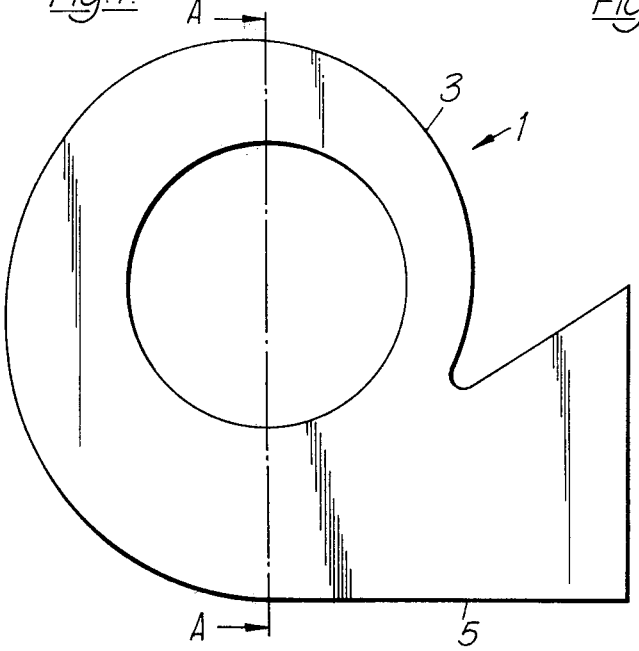
FIG. 1 shows a front profile view of a casing for a centrifugal fan according to one embodiment of the present invention.
Figure 2:
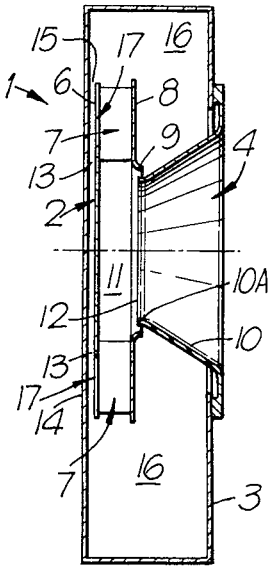
FIG. 2 shows a sectional side view of the fan through section A—A in FIG. 1 and including the fan impeller.
Figure 3:
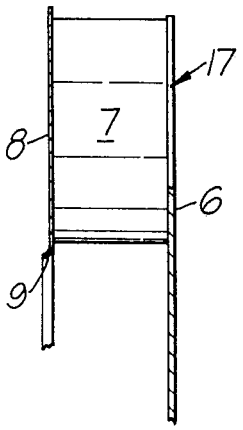
FIG. 3 show a side view of part of the impeller of FIG. 2.
Figure 4:
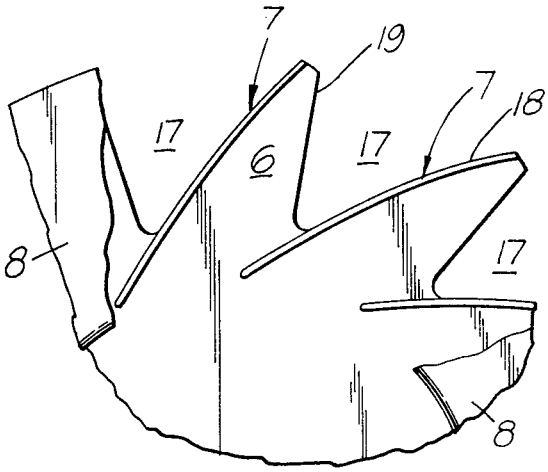
FIG. 4 shows a front view of a portion of the impeller of FIG. 3 with part of the front shroud omitted.
Figure 5:
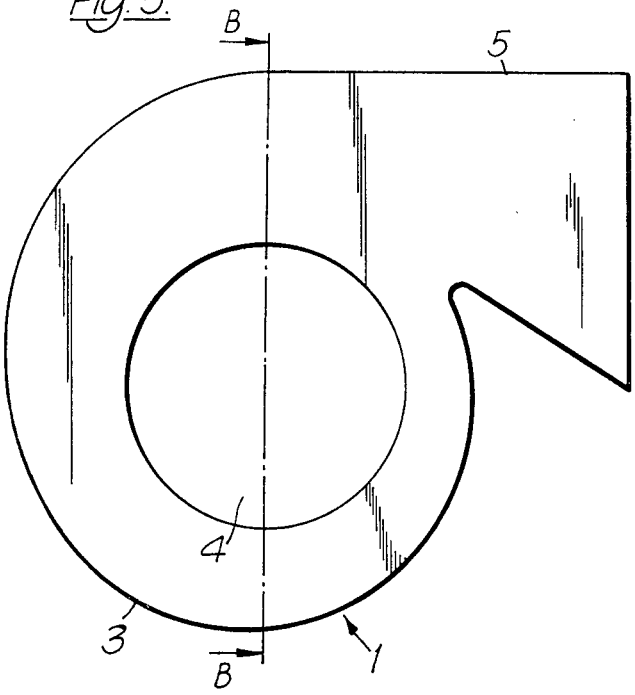
FIGS. 5 to 8 show similar views to FIGS. 1 to 4 respectively for a centrifugal fan according to a second embodiment of the present invention.
Figure 6:
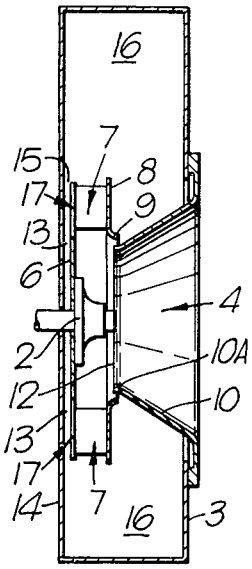
Figure 7:
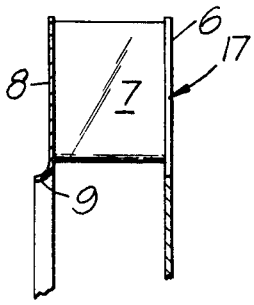
Figure 8:
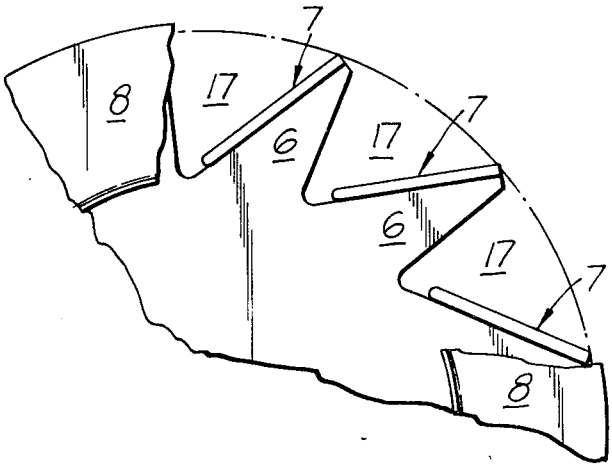

Referring to FIGS. 1 to 4, a centrifugal fan 1 of the single inlet type comprises an impeller 2 mounted for rotation in a scroll form casing 3, the casing 3 having an axial inlet 4 and a substantially tangential discharge 5 connectible to ducting (not shown) of a fan installation. The impeller 2 comprises a shaft-mounted radial back plate 6 having attached at the periphery thereof an annular series of outwardly extending and backwardly inclined vanes 7. Each vane 7 is of curved-plate form (see FIG. 4). and by way of example 13 vanes can be provided. Further, an annular front shroud 8 is attached to the front edges of the vanes and has its inner periphery 9 of bell-mouth form. A converging axial duct 10 delivers gas from the casing inlet 4 to the eye 11 of the impeller and this duct 10 has a bell rim 12 overlapped by the periphery 9 of the front shroud 8 for smooth flow of gas to the vanes 7 of the impeller 2.

In accordance with the present invention duct means are provided to create a recirculating flow of gas from the vane peripheral discharge zone back to the vanes. Specifically, these duct means comprise a radial fluid passage 13 (see FIG. 2) between the back plate 6 and an adjacent back wall 14 of the casing formed by spacing the plate 6 suitably from this wall 14, and the outer periphery 15 of this radial passage is open to define an inlet permitting gas flow from the vane discharge zone 16 to the passage 13. Additionally the periphery of the backplate 6 is cut away to form a peripheral series of general V-form notches 17 which enable recirculating gas flow from the radial passage 13 to the vanes 7. In this example each notch 17 extends annularly from a respective vane 7, having one edge 18 coincident with the vane 7, and the other edge 19 lying on an impeller radial line. Each notch 17 has a radial depth of approximately 75% of that of the vane.

In operation of the fan, a portion of the gas discharge by the impeller blades 7 into the discharge zone 16 is returned via the annular passage 13 and notches 17 to the blades 7, and this portion becomes proportionately greater as the volume discharge is reduced. In particular, it has been found that by means of this gas recirculation the pressure flow characteristic of the fan (see FIG.

Figure 9:
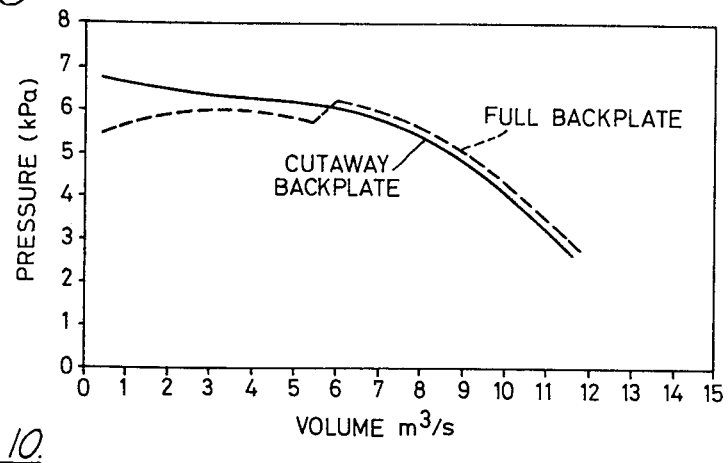
FIG. 9 shows a fan characteristic curve of pressure against discharge volume for the impeller of FIG. 3 in comparison with a conventional fan.
Figure 10:
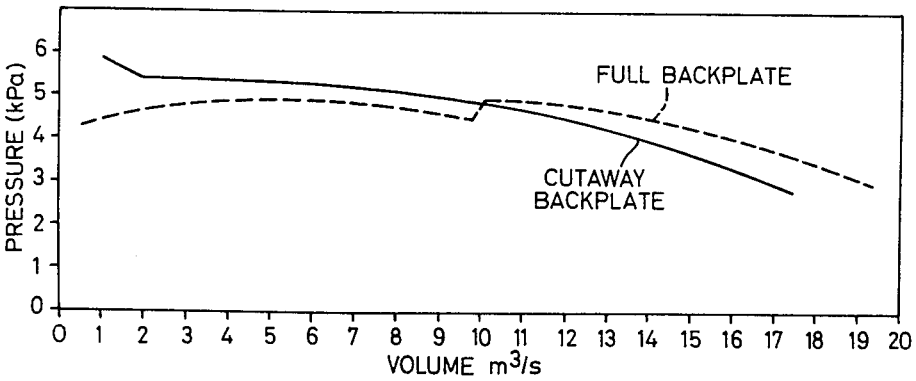
FIG. 10 shows a corresponding characteristic curve for the impeller of FIG. 7.

9) is adjusted so that at low delivery rates the fan pressure (or head) gradually increases as the capacity moves towards zero delivery rates; and as can be seen in FIG. 9, where the fall line represents the present fan while the dashed line represents the previous non-recycling fan, the pressure at low discharge rates with the present fan is greater than that of the comparable non-recycling fan. This characteristic of the present fan is more acceptable in some fan installations or systems, especially those where operation is at reduced discharge rates for considerable periods.

By way of example the above fan could have the following dimensions:

Impeller effective diameter—1265.4 mm
Impeller inlet diameter—646 mm
Impeller width—186 mm
Casing width—497.6 mm
Clearance backplate/casing—125 mm In a corresponding previous fan without recirculating means this backplate/casing clearance was 30 mm.

In the second embodiment of the present invention shown in FIGS. 5 to 8, a single-inlet centrifugal fan 1 is provided generally similar to that of the first embodiment and like parts carry the same reference numeral. However in this embodiment the vanes 7 comprise backwardly inclined flat plates. Also, similar recirculation duct means are provided but in this case the radial depth of the V-notches is greater than that of the vanes 7 by approximately 7%. This fan can have the following dimensions:

Impeller effective diameter—1033.8 mm
Impeller root diameter—687.0 mm
Clearance-backplate/casing—125 mm
Number of vanes—12

The recirculation may be less than 15% at design flow rates increasing to approximately 30% at low flow rates.

Figure 11:
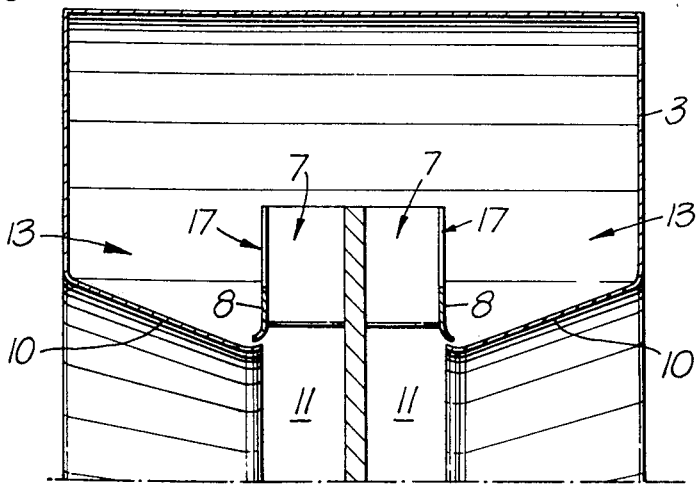
FIG. 11 shows the invention applied to a double inlet centrifugal fan.

It will be understood that the recirculation duct means could be of other form, but nevertheless for the fan still to be within the scope of the present invention. For example, these duct means could be arranged at the front end of the impeller as an alternative (or even additionally). Thus the space between the front shroud and the casing could constitute a radial fluid passage, and apertures could be provided on the front shroud similarly as those on the backplate for the first embodiment to permit gas return to the vanes. FIG. 11 shows this recirculation arrangement applied to a double-inlet centrifugal fan. Further it will be understood that the apertures could very well take some other form than notches: for example gas return holes could be formed in the backplate or shroud.

The above fans according to the present invention should find use for example in ventilation systems in industrial plant such as coal mines and steelworks. These fans could also be used for cooling gas recirculation in installations such as nuclear power stations.

We claim:

1. A centrifugal fan or compressor comprising a centrifugal impeller housed in a casing, said impeller having a series of outwardly extending vanes discharging into a peripheral zone and at least one end shroud for the vanes; and means for stabilising the pressure against flow characteristic of the fan or compressor at low operating speeds comprising recirculatory duct means including a radial clearance passage between said end shroud and the casing, a fluid inlet to said radial passage to enable gas to flow from said peripheral zone to the radial passage, notches extending from the free periphery of the end shroud over a substantial radial depth in the shroud for the flow of gas from said radial passage to the impeller vanes.

2. A fan or compressor as claimed in claim 1, wherein the shroud comprises an impeller back plate, the radial fluid passage being defined between the back plate and the casing.

3. A fan or compressor as claimed in claim 1, wherein the notches are located in an impeller front shroud.

4. A fan or compressor, as claimed in claim 3, wherein a double-bladed double-knit impeller is provided, including a pair of front shrouds each associated with respective blading, and notches are provided on each front shroud for gas recirculation to each of the blading.

5. A fan or compressor as claimed in claim 1, wherein an annular series of notches is provided, each located between successive vanes of the impeller.

6. A fan or compressor as claimed in claim 5, wherein the notches extend over a radial depth greater than that of the vanes.

7. A fan or compressor as claimed in claim 5, wherein the notches are of general "V" form, with one of the sides of the "V" coinciding with a side edge of a vane.

8. A fan or compressor as claimed in claim 7, wherein the other side of the "V" lies on an impeller radial line.

9. A fan or compressor as claimed in claim 1, wherein said end shroud is spaced from the casing by a distance approximately equal to 125 mm.

* * * * *